US005771545A

United States Patent [19]

Ellenberger

[11] Patent Number: 5,771,545

[45] Date of Patent: Jun. 30, 1998

[54] GARMENT STRAP RETAINER

[76] Inventor: Jane Ellenberger, 63 Gunckel Ave., Dayton, Ohio 45410

[21] Appl. No.: 798,430

[22] Filed: Feb. 10, 1997

Related U.S. Application Data

[60] Provisional application No. 60/011,956 Feb. 20, 1996.

[51] Int. Cl.[6] ..... A44B 9/12

[52] U.S. Cl. ..... 24/351; 24/357; 24/359

[58] Field of Search ..... 24/13, 3.11, 351, 24/357, 358, 359, 362

[56] References Cited

U.S. PATENT DOCUMENTS

| | | | |
|---|---|---|---|
| 323,688 | 8/1885 | Hug | 24/357 X |
| 722,617 | 3/1903 | Peet | 24/357 |
| 740,178 | 9/1903 | Rait, Jr. | 24/351 X |
| 773,711 | 11/1904 | Campbell | 24/359 |
| 928,585 | 7/1909 | Cinnamon | 24/359 X |
| 950,031 | 2/1910 | Stach | 24/357 X |
| 1,248,123 | 11/1917 | Huckbody | 24/357 X |
| 1,321,534 | 11/1919 | Mantle | 24/357 X |
| 1,577,993 | 3/1926 | Weinstein | 24/357 |
| 5,441,188 | 8/1995 | Rosenstein | 24/351 X |

FOREIGN PATENT DOCUMENTS

| | | | |
|---|---|---|---|
| 3484 | 10/1900 | Australia | 24/357 |
| 10527 | 2/1934 | Australia | 24/357 |
| 386671 | 6/1908 | France | 24/357 |
| 332829 | 2/1921 | Germany | 24/357 |
| 24431 | 10/1896 | United Kingdom | 24/357 |
| 17633 | 10/1900 | United Kingdom | 24/357 |
| 254891 | 7/1926 | United Kingdom | 24/357 |

*Primary Examiner*—Peter M. Cuomo
*Assistant Examiner*—Robert J. Sandy
*Attorney, Agent, or Firm*—R William Graham

[57] ABSTRACT

A garment strap retainer for use in retaining a strap of one piece of garment in a relatively fixed position with respect to another piece of garment and includes a first resilient member having a first end, an intermediate portion and a second end, a second resilient member having a first end, an intermediate portion and a second end, wherein the second resilient member is disposed adjacent the first resilient member such that the first ends of the resilient members are disposed adjacent one another in a relatively fixed manner and have a first retention contact point formed therebetween, the intermediate portions are movably disposed adjacent one another and the second ends are movably disposed adjacent one another and have a second retention contact point formed therebetween and wherein the second ends may be forcibly displaced from one another in a manner to break the retention contact point and to permit the strap to be positioned between the intermediate portions and upon replacement of the second ends the second retention contact point is reformed such that the strap is retained between the retention contact points and also includes means connected to one of the resilient members for removably connecting to the another garment piece.

9 Claims, 2 Drawing Sheets

GARMENT STRAP RETAINER

This is a continuation-in-part of copending application Ser. No. 60/011,956 filed on Feb. 20, 1996.

BACKGROUND OF THE INVENTION

1. Field of the Invention

The present invention relates to the field of garment fasteners. More particularly, but not by way of limitation, the invention relates to garment strap retainers for use in quickly securing a strap of one garment piece to a predetermined position on another garment piece.

2. Related Art

Currently, it is desirable to women to preclude the showing of undergarments and parts thereof, such as a bra or a slip and associated straps, from the primary outer garment. This occurs commonly in wearing certain dresses, blouses or sweaters which utilize a design cut which is more revealing wherein there exists the need to cover the undergarment straps.

In order to do so, women presently employ the use of a conventional safety pin or the like. In this regard, the safety pin pins the undergarment strap to the inside of the outer garment. A problem with using such safety pins is that they are often difficult to secure and remove and done while the user wears the under and outer garments. Not infrequently the user's fingers will get injured from the pin as it is difficult to see or position the pin.

Other devices attempting to solve the problem have employed the use of Velcro, fabric, elastic or snaps. However, these too have not met with acceptability in the market for reasons of their complexity, ineffectiveness or expense.

There is a need to overcome the problems described above. In this respect it is desired to have a device which solves the problems which exist with the art.

BRIEF SUMMARY OF THE INVENTION

It is an object to improve garment strap retention.

It is another object to provide a garment strap retainer which is relatively inexpensive and user friendly.

It is yet another object that the garment strap retainer of the present invention be one time connectable to the outer garment and permit quick fastening and retention of the undergarment strap without disconnecting the garment strap retainer from the outer garment and reducing the risk to the user.

Accordingly, the present invention is directed to a garment strap retainer for use in retaining a strap of one piece of garment in a relatively fixed position with respect to another piece of garment. The garment strap retainer includes a first resilient member having a first end, an intermediate portion and a second end, a second resilient member having a first end, an intermediate portion and a second end. The second resilient member is disposed adjacent the first resilient member such that the first ends of the resilient members are disposed adjacent one another in a relatively fixed manner and have a first retention contact point formed therebetween. The intermediate portions are movably disposed adjacent one another and the second ends are movably disposed adjacent one another and have a second retention contact point formed therebetween and wherein the second ends may be forcibly displaced from one another in a manner to break the retention contact point and to permit the strap to be positioned between the intermediate portions and upon replacement of the second ends the second retention contact point is reformed such that the strap is retained between the retention contact points. Also, included are means connected to one of the resilient members for removably connecting to the another garment piece.

Other objects and advantages will be readily apparent to those skilled in the art upon viewing the drawings and reading the detailed description hereafter.

DETAILED DESCRIPTION OF THE PREFERRED EMBODIMENTS OF THE INVENTION

Figure 1:
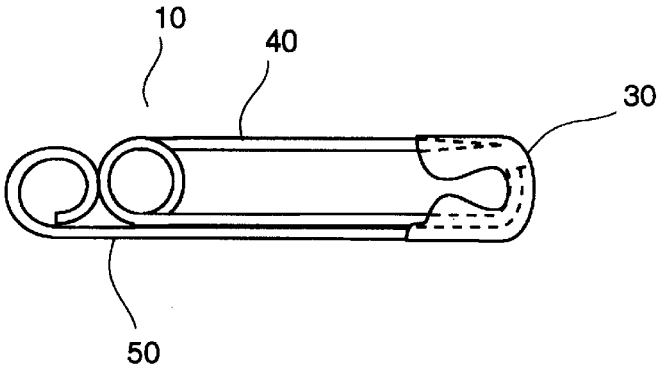
FIG. 1 is a side view of an embodiment of the present invention in a closed position.
Figure 4:
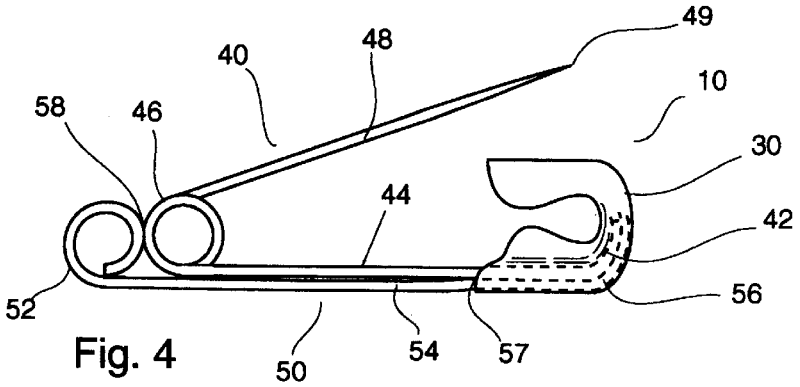
FIG. 4 is a side view of the embodiment of FIG. 1 in an open position.

Referring now to the drawings, the garment strap retainer and elements thereof of the present invention are represented. In FIG. 1, the garment strap retainer is represented by the number 10 and is in a closed position whereas FIG. 4 depicts an open position. The garment strap retainer 10 includes a clasp 30 and resilient members 40 and 50.

Figure 2:
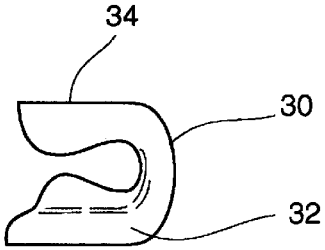
FIG. 2 is a side view of a clasp member shown in FIG. 1.

FIG. 2 shows clasp 30. Clasp 30 has a crimped end 32 and another end 34 which forms an open seat area.

Figure 3A:
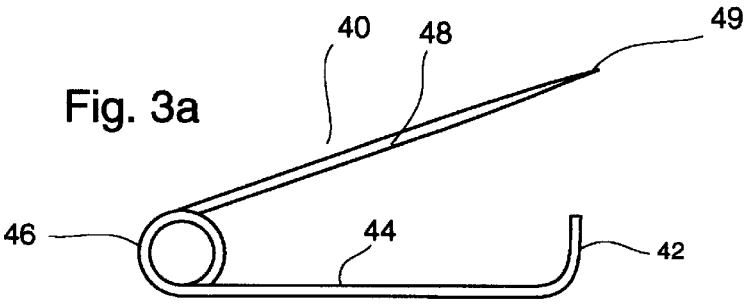
FIG. 3*a* a side view of a resilient member shown in FIG. 1.
Figure 3B:
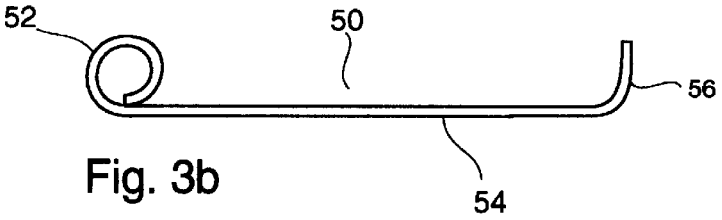
FIG. 3*b* a side view of another resilient member shown in FIG. 1.

FIGS. 3*a* and 3*b* show two resilient members 40 and 50, respectively, used in the embodiment of the garment strap retainer 10. Resilient member 40 includes an arcuate portion 42, particularly shown here to be about 90° rounded for the purpose of permitting retention of the resilient member 40 by the clasp 30 in a manner further described below. Extending from the arcuate end 42 is a relatively straight portion 44 which connects to an intermediate arcuate blunt portion 46, particularly shown here to 540° but could be 180°, and which connects to a second relatively straight end 48 which terminates in a relatively sharp pointed end 49.

The resilient member 50 includes an end rounded blunt 52 which is formed in an arcuate manner, particularly shown here to be about 360° rounded. Extending from the rounded end 52 is a relatively straight portion 54 which connects to a second arcuate portion 56, particularly shown here to be about 90° rounded for the purpose of permitting retention of the resilient member 50 by the clasp 30 in a manner further described below.

The straight portion 44 is shorter than straight portion 54. The resilient member 40 is disposed adjacent resilient member 50 such that straight portions 44 and 54 are parallel and adjacent one another with ends 42 and 56 fixedly disposed in crimped end 32 of clasp 30 to form a retention contact point 57, as shown in FIG. 4, and end 52 and arcuate portion 46 are touching to form another retention contact point 58.

The terminal point 49 of end 48 can be removably disposably seated within the end 34 of the clasp 30. In this regard, the end 48 may be removed from the end 34 to form an open position as seen in FIG. 4 for the purpose of securing the garment strap retainer 10 to a garment and then disposed in the end 34 to form a closed position as seen in FIG. 1. The strap is forced by the retention contact point 58 and maintained between the straight portions 44 and 54. In this regard, the straight portions 44 and 54 are movably disposed adjacent one another and ends 46 and 52 are movably disposed adjacent one another and wherein ends 46 and 52 are directly forcibly oppositely displaced from one another in a manner to break the retention contact point 58 to permit the strap to be positioned between straight portions 44 and 54 whereupon release and replacement of ends 46 and 52, the retention contact point 58 is reformed and the strap is retained between retention contact points 57 and 58.

The garment strap retainer 10 is preferably fastened to an area of the garment, such as an inner lining of a shoulder portion area predetermined adjacent a strap of a bra, for example, and may be left permanently fixed thereto the garment if so desired. The strap may then be removably disposed between the straight portions 44 and 54 in a retained fashion by sliding the strap by the retention contact point 58.

Figure 5:
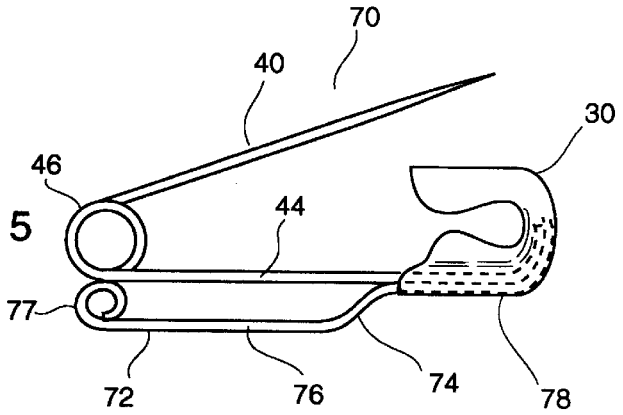
FIG. 5 is a side view of yet another embodiment of the present invention.
Figure 6:
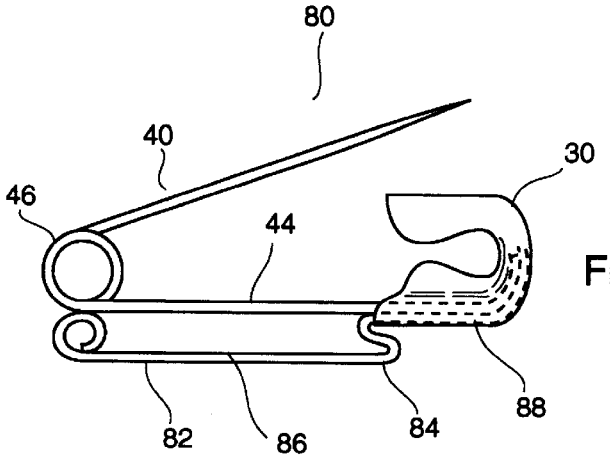
FIG. 6 is a side view of still another embodiment of the present invention.
Figure 7:
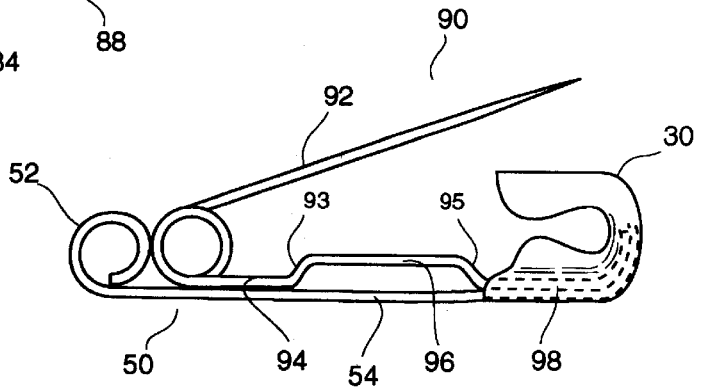
FIG. 7 is a side view of even another embodiment of the present invention.

While the embodiment shown in FIGS. 1–4 is suitable for relatively thin straps, the embodiments 70, 80 and 90 of FIGS. 5–7, respectively, show alternative embodiments for use with thicker straps. Particularly for FIGS. 5 and 6, the clasp 30 and resilient member 40 are essentially the same and the resilient member 50 is replaced with either resilient member 72 or 82. Here, resilient member 72 includes an arcuate bend 74 between straight portions 76 and 78 such that straight portion 76 is in spaced parallel relation to straight portion 44 of resilient member 40 and includes a 360° rounded blunt end 77 which is in contact with arcuate blunt portion 46 to form a retention contact point therebetween. Likewise, resilient member 82 includes another type arcuate bend 84 and is otherwise similarly formed.

FIG. 7 shows an embodiment 90 having similarly formed resilient member 50 and clasp 30 and resilient member 40 being replaced with resilient member 92. Here, the resilient member 92 includes arcuate bends 93 and 95 between straight portions 94, 96 and 98, respectively, to laterally space portion 96 from straight portion 54 in parallel relation.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A garment strap retainer for use in retaining a strap of one piece of garment in a relatively fixed position with respect to another piece of garment, which includes:

a first resilient member having a first end, an intermediate portion and a second blunt end;

a second resilient member having a first end, an intermediate portion and a second blunt end, wherein said second resilient member is disposed adjacent said first resilient member such that said first ends of said resilient members are disposed adjacent one another in a relatively fixed manner and have a first retention contact point formed therebetween, said intermediate portions are movably disposed adjacent one another and said second ends are movably disposed adjacent one another and have a second retention contact point formed therebetween and wherein said second ends may be directly forcibly oppositely displaced from one another in a manner to break said second retention contact point and to permit the strap to be positioned between said intermediate portions and upon replacement of said second ends, said second retention contact point is reformed such that the strap is retained between said retention contact points; and means connected to one of said resilient members for removably connecting to the another piece of garment.

2. The garment strap retainer of claim 1, wherein said second ends are arcuate.

3. The garment strap retainer of claim 1, wherein said intermediate portions are spaced from one another.

4. The garment strap retainer of claim 1, wherein said first retention contact point is further characterized such that said first ends are integrally formed.

5. A garment strap retainer for use in retaining a strap of one piece of garment in a relatively fixed position with respect to another piece of garment, which includes:

a first resilient member having a first ends an intermediate portion and a second end;

a second resilient member having a first end, an intermediate portion and a second end, wherein said second resilient member is disposed adjacent said first resilient member such that said first ends of said resilient members are disposed adjacent one another in a relatively fixed manner and have a first retention contact point formed therebetween, said intermediate portions are movably disposed adjacent one another and said second ends are movably disposed adjacent one another and have a second retention contact point formed therebetween and wherein said second ends may be forcibly displaced from one another in a manner to break said second retention contact point and to permit the strap to be positioned between said intermediate portions and upon replacement of said second ends, said second retention contact point is reformed such that the strap is retained between said retention contact points; and means connected to one of said resilient members for removably connecting to the another piece of garment wherein said connecting means includes a third resilient member having a first end, an intermediate portion and a second end, wherein said first end is connected to said first end of said first resilient member and said second end characterized to be sharp and pointed, and a clasp having one end connected to said second ends of said first and second resilient members and another end forming a seat to removably receive said second end of said third resilient member thereagainst.

6. The garment strap retainer of claim 5, wherein said second ends of said first and second resilient members are blunt.

7. The garment strap retainer of claim 6, wherein said second ends of said first and second resilient members are arcuate.

8. The garment strap retainer of claim 5, wherein said intermediate portions are spaced from one another.

9. The garment strap retainer of claim 5, wherein said first retention contact point is further characterized such that said first ends of said first and second resilient members are integrally formed.

* * * * *